US006085619A

United States Patent [19]

Blake et al.

[11] Patent Number: 6,085,619

[45] Date of Patent: Jul. 11, 2000

[54] TOOL BIT ADAPTER FOR UNIVERSAL SOCKET TOOL

[75] Inventors: Jonathon D. Blake, Harwich Port, Mass.; Joel S. Marks, Los Angeles, Calif.

[73] Assignee: WorkTools, Inc., Chatsworth, Calif.

[21] Appl. No.: 09/133,526

[22] Filed: Aug. 13, 1998

[51] Int. Cl.[7] ..... B25B 23/00

[52] U.S. Cl. ..... 81/438; 87/177.85

[58] Field of Search ..... 81/438, 439, 177.85

[56] References Cited

U.S. PATENT DOCUMENTS

| | | | |
|---|---|---|---|
| 3,312,260 | 4/1967 | MacNeill | 81/438 |
| 5,343,786 | 9/1994 | Wridt | 81/438 |
| 5,460,064 | 10/1995 | Zayat . | |
| 5,485,769 | 1/1996 | Olson et al. | 81/438 X |
| 5,564,717 | 10/1996 | Alberts | 81/438 X |
| 5,622,090 | 4/1997 | Marks . | |
| 5,791,209 | 8/1998 | Marks . | |

*Primary Examiner*—James G. Smith
*Attorney, Agent, or Firm*—Paul Y. Feng; Fulwider Patton Lee & Utecht, LLP

[57] ABSTRACT

An adapter for adapting use of a universal socket tool or wrench to a tool bit is disclosed. The universal socket contains a plurality of spring biased pins closely packed in parallel to apply torque to bolts, nuts, and similar fasteners. To broaden the utility of such a universal socket, the adapter holds a hex shanked screwdriver bit into the socket so that the pins can apply torque to the screwdriver shank. The adapter further stabilizes the bit drive end so that the bit does not wobble. The adapter has a body with a hole at one end to receive a bit and a recess at the opposite end to receive the socket. The adapter is made of an elastomeric material so that the bit can easily be forced into the hole and the socket can be forced into the recess. The recess has a minimum inside width or diameter at its open end so that a lip of the recess contacts the socket exterior away from the socket end.

8 Claims, 3 Drawing Sheets

TOOL BIT ADAPTER FOR UNIVERSAL SOCKET TOOL

FIELD OF THE INVENTION

The present invention relates to fastener driving tools. More precisely, the present invention relates to an adapter device which enables a universal socket tool to be used as a screwdriver.

BACKGROUND OF THE INVENTION

The present invention is preferably intended to be attached to a universal socket tool such as that disclosed in U.S. Pat. Nos. 5,791,209; 5,622,090; and 5,460,064, whose entire contents are hereby incorporated by reference. In general, the above patents disclose universal socket tools which use a plurality of closely packed pins bundled within a socket wrench body. The pins move lengthwise against a spring bias to enable the pins to surround a bolt head or other irregularly shaped fastener.

However, such pins are not practical for driving screws. Screws require a finely fitted device to fit the small slot in the screw head. Although U.S. Pat. No. 5,460,064 shows specialized pins for screw driving, a screw is most practically driven by an extending screwdriving bit. The body of a standard ¼" hexagonal screwdriver bit is similar to a ¼" bolt head. If the pins of the universal socket tool are of sufficiently fine resolution, the pins can drive the hexagonal body. But the spring loaded pins tend to eject the bit lengthwise out of the socket. Hence, there is a need for a universal socket tool adapter that can adapt use of universal sockets to conventional tool bits.

SUMMARY OF THE INVENTION

To meet the foregoing need, the present invention is directed to an adapter capable of use in combination with a universal socket tool or wrench. As described above, such a socket tool has a body with an exterior surface and an interior cavity containing a plurality of closely packed, parallel pins, wherein the pins are biased by springs toward an open end of the interior cavity.

The present invention adapter comprises a hole through a body of the adapter, the hole extending in an axial direction along a length of the adapter; an interior wall of the adapter surrounding a recess of the adapter; an elongated screwdriver bit with a drive end and a rear end, the rear end being of polygonal cross-section and having a larger maximum diameter at the polygon corners than an inside diameter of the hole, and the socket body exterior surface has a larger dimension than an inside dimension of the recess; the screwdriver bit being pressed into the hole wherein the bit rear end presses a top of at least one pin, the at least one pin being displaced inward away from the open end of the interior cavity; the socket body being pressed into the recess; the screwdriver bit rear end thereby being surrounded by the remaining closely packed pins that are not displaced inward by the bit; friction between the bit and the hole and between the recess and the socket exterior causing the bit rear end to be held within the socket interior cavity against the force of at least one spring biasing the at least one pin; and the adapter holding the bit drive end in alignment in the axial direction of the adapter.

The present invention adapter therefore gently positions the bit inside the socket and provides a holding function. To be sure, the present invention adapter preferably serves at least two functions: first, to retain the bit from falling out of the socket; and second, to help align the bit axially so that the bit does not wobble. Importantly, the present invention adapter does not need to transmit torque between the socket and the bit since the pins transmit the torque to the bit body through their normal function. One essential concept of the present invention is that a relatively weak adapter, such as might be constructed of elastomeric material, can assist in transmission of large torques between the universal socket and the screwdriver bit.

DETAILED DESCRIPTION OF THE PREFERRED EMBODIMENTS

Figure 1:
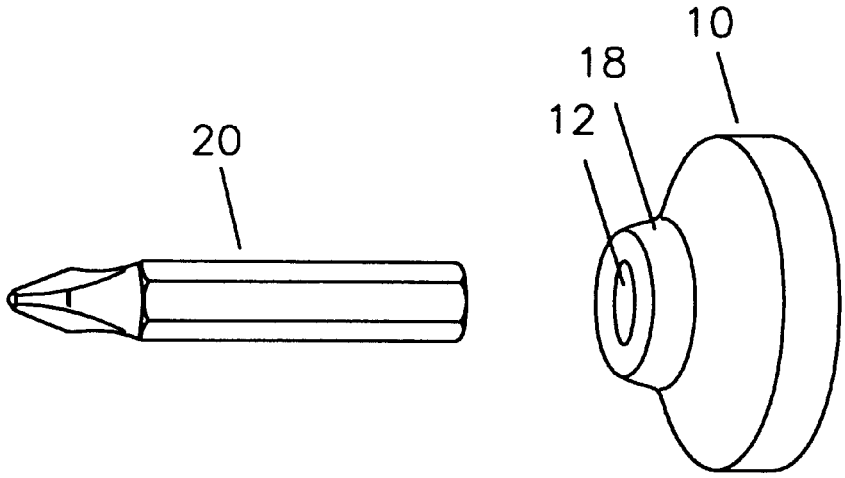
FIG. 1 is an isometric view of an adapter of the present invention positioned behind a screwdriver bit as they would be before assembly.
Figure 2:
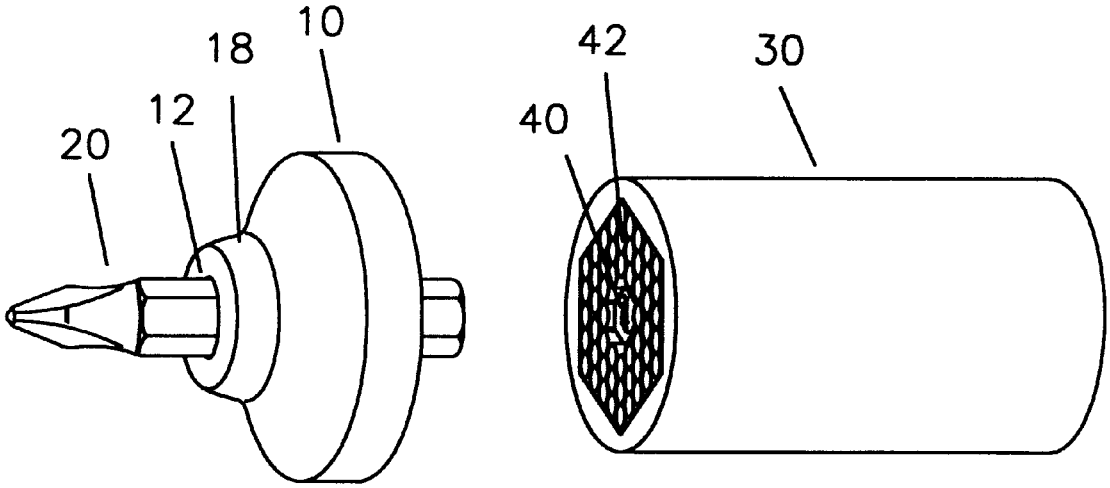
FIG. 2 is an isometric view of the adapter of FIG. 1 assembled around a screwdriver bit, where the assembly in a position to be fitted to a universal socket.

FIGS. 1 and 2 are perspective views of a preferred embodiment of the present invention universal socket tool bit adapter 10. In FIG. 1, adapter 10 is shown with a typical tool bit 20. In FIG. 2, tool bit 20 is inserted into adapter 10, and just prior to attachment to universal socket tool 30. The construction of universal socket tool 30 is described above.

Figure 3:
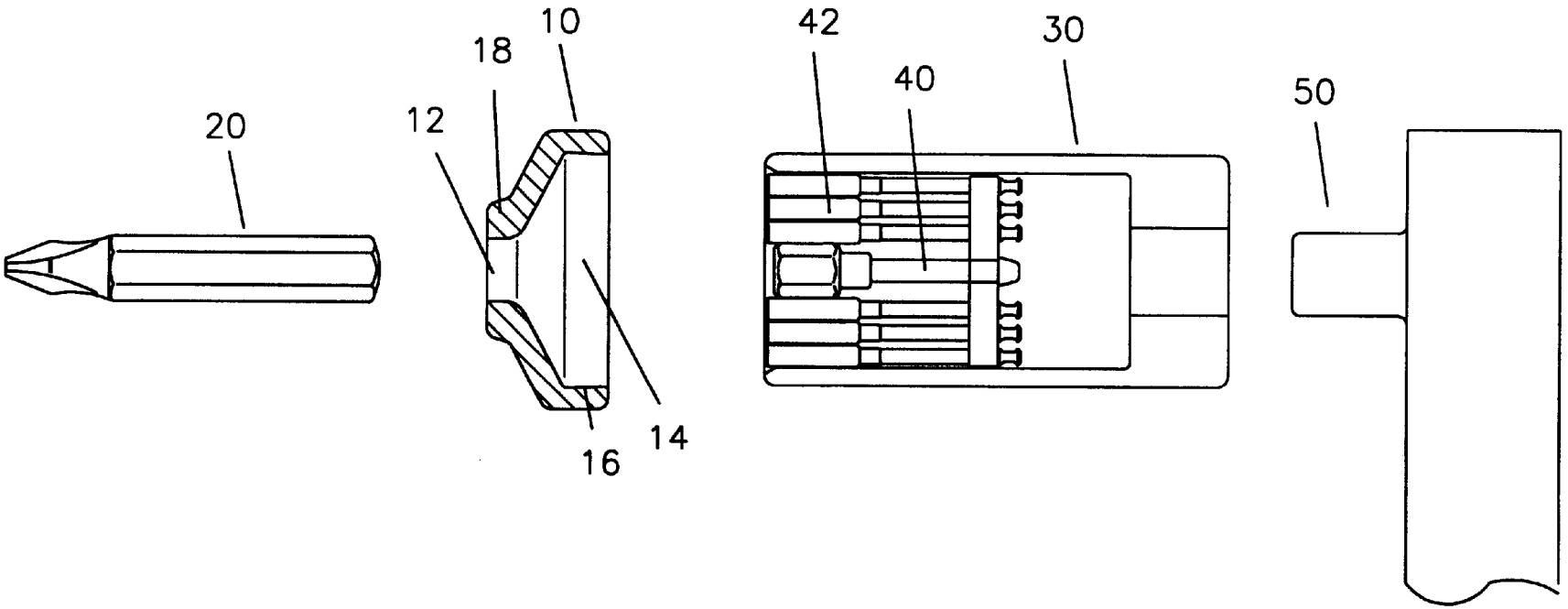
FIG. 3 is an exploded, side elevational view, partly in section, of an assembly of a screwdriver bit, the adapter of FIG. 1, a universal socket, and a socket driving tool.

A preferred embodiment adapter 10 is constructed of an elastomeric material. Other tool grade materials are contemplated. Hole 12 extends in a direction defining a central axis of adapter 10. Screwdriver bit 20 has a slightly larger maximum diameter than hole 12. When bit 20 is pressed into hole 12 as in FIG. 2, bit 20 is slidably retained in hole 12 by friction. Similarly, as best seen in FIG. 3, universal socket tool 30 is pressed into recess 14 of adapter 10. Interior wall 16 of adapter 10 defines a recess width and in a preferred embodiment is canted inward in the direction toward socket 30 so that recess 14 contacts the exterior wall of socket 30 primarily away from the end of the socket. Alternatively, an extended rib or lip on wall 16 at the open end of recess 14 would serve the same function.

If wall 16 were straight and parallel to the external wall of socket 30, and adapter 10 were pressed on to socket 30, flexing of the material of adapter 10 might cause wall 16 to spread outward. Adapter 10 could then potentially slide off of socket 30.

Figure 4:
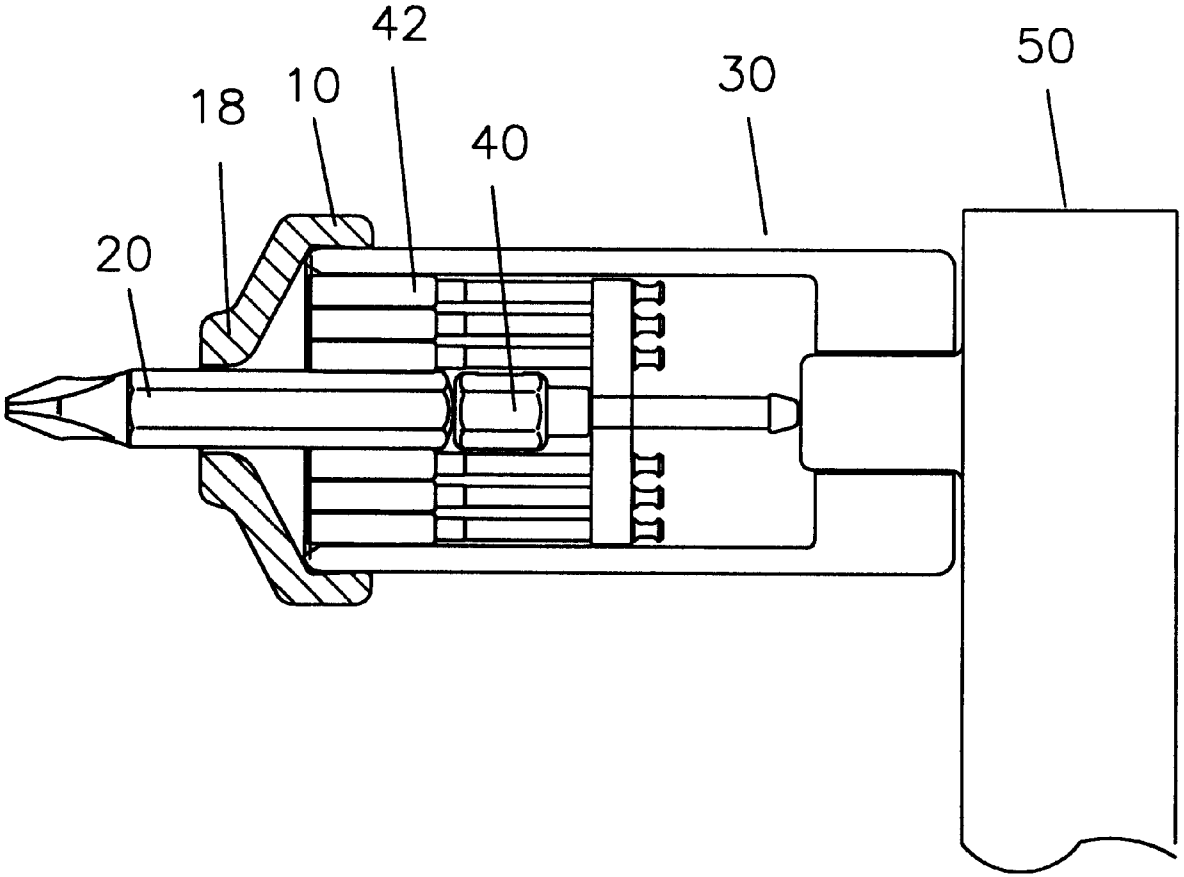
FIG. 4 is a side elevational view of the assembly from FIG. 3, partly in section, of a screwdriver bit, the adapter of FIG. 1, a universal socket, and a socket driving tool.

As seen in FIGS. 2 and 3, the exemplary universal socket tool 30 has a center pin 40, surrounded by smaller closely packed torque pins 42. Each pin 42 has a spring (not shown) to bias the pin 42 toward the open end of socket 30. Center pin 40 defines the space into which screwdriver bit 20 is fitted. As shown in the assembly of FIG. 4, screwdriver bit 20 displaces center pin 40 into the interior of socket 30. Friction between bit 20 and hole 12 holds bit 20 against the force of the spring (not shown) that biases pin 40 outward.

The adapter 10 of the present invention need not be limited to function with a round bodied universal socket containing a center pin. For example, the universal socket tool disclosed in U.S. Pat. No. 5,460,064 has a square body packed with identical pins. Accordingly, in an alternative embodiment of the present invention, recess 14 could have a square shape and screwdriver bit 20 would press a plurality of ordinary pins 42 at the center of the socket. Similarly pins 42 need not be of a round cross-section.

The function of the adapter of the present invention is limited only in that pins 42 or analogous elements of an associated universal socket tool must be capable of turning screwdriver bit 20 when torque is applied by driving tool 50, shown in FIGS. 3 and 4. In the case where screwdriver bit 20 has a standard ¼" hex shank, the pins must be of fine resolution, meaning small and numerous, to reliably grasp the ¼" shank. The universal socket tool is intended to drive bolts and similar fasteners; the shank of bit 20 is essentially a ¼" bolt head. The screwdriver bit shank could be of any polygonal shape.

In the preferred embodiment of the present invention, hole 12 is round. Screwdriver bit 20 can rotate within hole 12 until bit 20 is correctly aligned with torque pins 42. Bit 20 can then move into socket 30, or pins 42 can pop up around bit 20, so that a strong torque connection is made between the universal socket and screwdriver bit 20. Adapter 10 supports bit 20 against wobble and prevents center pin 40, or centrally located pins 42, from ejecting bit 20 out of socket 30.

An extended collar 18 surrounding hole 12 may be included. Collar 18 provides additional support against wobble for bit 20. Bit 20 is shown with a Phillips type drive end. Other well-known styles of bit may be used, such as slotted, hex, square, or star.

It is understood by those skilled in the art that the foregoing descriptions are preferred embodiments of the present invention. Various changes and modifications may be made to those preferred embodiments without departing from the spirit and scope of the present invention.

What is claimed is:

1. An adapter able to be used in combination with a universal socket wrench, wherein the socket wrench has a body with an exterior surface and an interior cavity containing a plurality of closely packed pins in parallel, the pins biased by springs toward an open end of the interior cavity, the adapter comprising:

a hole through a body of the adapter, the hole extending in an axial direction along a length of the adapter;

an interior wall of the adapter surrounding a recess of the adapter;

an elongated screwdriver bit with a drive end and a rear end, the rear end being of polygonal cross section and having a larger maximum diameter at the polygon corners than an inside diameter of the hole, and the socket body exterior surface has a larger dimension than an inside dimension of the recess;

the screwdriver bit being pressed into the hole wherein the bit rear end presses a top of at least one pin, the at least one pin being displaced inward away from the open end of the interior cavity;

the socket body being pressed into the recess;

the screwdriver bit rear end thereby being surrounded by the remaining closely packed pins that are not displaced inward by the bit;

friction between the bit and the hole and between the recess and the socket exterior causing the bit rear end to be held within the socket interior cavity against the force of at least one spring biasing the at least one pin; and the adapter holding the bit drive end in alignment in the axial direction of the adapter.

2. The adapter of claim 1, wherein the recess has a length along the length of the adapter and a width, the recess has an open end facing the socket wrench when the adapter and socket wrench are assembled together, and the width decreases toward the recess open end.

3. The adapter of claim 1, wherein at least one of the hole and the recess describe a substantially cylindrical interior.

4. The adapter of claim 1, wherein an extension of the body of the adapter surrounds the hole and extends lengthwise away from the recess.

5. The adapter of claim 1, wherein the adapter includes an elastomeric material.

6. An adapter for mounting a tool bit to a universal socket wrench, wherein the socket wrench includes a body with a cylindrical exterior surface and an interior cavity containing a plurality of closely packed pins disposed in parallel, the pins biased toward an open end of the interior cavity, the adapter comprising:

a disk shape, deformable body having a projecting section leading to a cylindrical section;

a small hole through the projecting section, the hole extending in an axial direction along a length of the body;

an interior wall within the cylindrical section forming a circumferential lip, wherein the circumferential lip includes a diameter smaller than an outside diameter of the universal socket tool for an interference fit;

wherein the tool bit is force fit through the small hole and the circumferential lip partially overlies the cylindrical surface at the open end of the universal socket wrench.

7. The adapter of claim 6, wherein the projecting section includes a tapered profile.

8. The adapter of claim 6, wherein the interior wall of the circumferential lip is canted.

* * * * *